US007771160B2

(12) United States Patent
Shi et al.

(10) Patent No.: US 7,771,160 B2
(45) Date of Patent: Aug. 10, 2010

(54) CERAMIC SHROUD ASSEMBLY

(75) Inventors: Jun Shi, Glastonbury, CT (US); Shaoluo L. Butler, Manchester, CT (US); Kevin E. Green, Broad Brook, CT (US)

(73) Assignee: United Technologies Corporation, Hartford, CT (US)

( * ) Notice: Subject to any disclaimer, the term of this patent is extended or adjusted under 35 U.S.C. 154(b) by 794 days.

(21) Appl. No.: 11/502,212

(22) Filed: Aug. 10, 2006

(65) Prior Publication Data

US 2010/0104433 A1 Apr. 29, 2010

(51) Int. Cl.
*F01D 11/18* (2006.01)

(52) U.S. Cl. ..... 415/138; 415/173.3; 415/200

(58) Field of Classification Search ..... 415/134–136, 415/138, 139, 173.1, 173.3, 173.4, 177, 178, 415/200
See application file for complete search history.

(56) References Cited

U.S. PATENT DOCUMENTS

| | | | | |
|---|---|---|---|---|
| 3,295,824 | A | 1/1967 | Woodwell et al. | |
| 3,825,364 | A | 7/1974 | Halila et al. | |
| 3,901,622 | A | 8/1975 | Ricketts | |
| 4,008,978 | A | 2/1977 | Smale | |
| 4,087,199 | A * | 5/1978 | Hemsworth et al. | 415/173.3 |
| 4,398,866 | A | 8/1983 | Hartel et al. | |
| 4,411,594 | A * | 10/1983 | Pellow et al. | 415/173.3 |
| 4,439,981 | A | 4/1984 | Weiler et al. | |
| 4,502,809 | A * | 3/1985 | Geary | 403/28 |
| 4,522,557 | A | 6/1985 | Bouiller et al. | |
| 4,639,194 | A | 1/1987 | Bell, III et al. | |
| 4,643,638 | A | 2/1987 | Laurello | |
| 4,650,395 | A | 3/1987 | Weidner | |
| 4,669,954 | A * | 6/1987 | Habarou et al. | 415/174.4 |
| 4,679,981 | A | 7/1987 | Guibert et al. | |
| 4,684,320 | A | 8/1987 | Kinz | |
| 4,759,687 | A | 7/1988 | Miraucourt et al. | |
| 5,080,557 | A | 1/1992 | Berger | |
| 5,167,487 | A | 12/1992 | Rock | |
| 5,169,287 | A | 12/1992 | Proctor et al. | |
| 5,181,826 | A | 1/1993 | Rock | |

(Continued)

FOREIGN PATENT DOCUMENTS

EP 0492865 A1 7/1992

(Continued)

OTHER PUBLICATIONS

Jimenez, O., Mclain, J., Edwards, B., Parthasasathy, V., Bagheri, H. and Bolander, G., "Ceramic Stationary Gas Turbine Development Program-design and Test of a Ceramic Turbine Blade," ASME 98-GT-529, International Gas Turbine and Aeroengine Congress and Exhibition, Stockholm, Sweden, 1998, (pp. 1-9).

(Continued)

*Primary Examiner*—Edward Look
*Assistant Examiner*—Nathaniel Wiehe
(74) *Attorney, Agent, or Firm*—Kinney & Lange, P.A.

(57) ABSTRACT

A ceramic shroud assembly suitable for use in a gas turbine engine comprises a metal clamp ring shrink fitted around a ceramic shroud ring and an insulating and compliant interlayer. The interlayer is positioned between the metal clamp ring and the ceramic shroud ring.

20 Claims, 5 Drawing Sheets

U.S. PATENT DOCUMENTS

| | | | | |
|---|---|---|---|---|
| 5,279,031 | A | 1/1994 | Carruthers et al. | |
| 5,333,992 | A | 8/1994 | Kane et al. | |
| 5,368,095 | A | 11/1994 | Kadambi et al. | |
| 5,439,348 | A | 8/1995 | Hughes et al. | |
| 5,486,090 | A | 1/1996 | Thompson et al. | |
| 5,562,408 | A | 10/1996 | Proctor et al. | |
| 5,609,469 | A | 3/1997 | Worley et al. | |
| 6,048,170 | A | 4/2000 | Dodd | |
| 6,139,257 | A | 10/2000 | Proctor et al. | |
| 6,250,883 | B1 | 6/2001 | Robinson et al. | |
| 6,340,285 | B1 | 1/2002 | Gonyou et al. | |
| 6,354,795 | B1 | 3/2002 | White et al. | |
| 6,368,054 | B1 | 4/2002 | Lucas | |
| 6,733,233 | B2 | 5/2004 | Jasklowski et al. | |
| 6,758,653 | B2 | 7/2004 | Morrison | |
| 6,932,566 | B2 | 8/2005 | Suzumura et al. | |
| 6,942,445 | B2 * | 9/2005 | Morris et al. | 415/1 |
| 6,997,673 | B2 * | 2/2006 | Morris et al. | 415/1 |
| 7,008,183 | B2 | 3/2006 | Sayegh et al. | |
| 7,033,138 | B2 | 4/2006 | Tomita et al. | |
| 7,117,983 | B2 | 10/2006 | Good et al. | |
| 7,290,982 | B2 | 11/2007 | Girard et al. | |
| 2001/0021343 | A1 | 9/2001 | Kuwabara et al. | |
| 2005/0232752 | A1 | 10/2005 | Meisels | |
| 2008/0010990 | A1 | 1/2008 | Shi et al. | |

FOREIGN PATENT DOCUMENTS

| | | | |
|---|---|---|---|
| JP | 9228804 | A2 | 9/1997 |

OTHER PUBLICATIONS

Norton, Frey, G. A., Bagheri, H., Flerstein, A., Twardochieb, C., Jimenez, O., and Saith, A., "Ceramic Stationary Gas Turbine Development Program-Design and Life Assessment of Ceramic Components," ASME Paper 95-GT-383, International Gas Turbine and Aeroengine Congress and Exhibition, Houston, Texas, 1995, (pp. 1-9).

Sinnet, G.T., French, J.M. and Groseciose, L.E., "Progress on the Hybrid Vehicle Turbine Engine Technology Support (HVTE-TS) Program," ASME Paper 97-GT-88, International Gas Turbine and Aeroengine Congress and Exhibition, Orlando, Florida, 1997, (pp. 1-13).

* cited by examiner

CERAMIC SHROUD ASSEMBLY

STATEMENT OF GOVERNMENT INTEREST

This invention was made with Government support under contract number W31P4Q-05-D-R002, awarded by the U.S. Army Aviation and Missile Command Operation and Service Directorate. The U.S. Government has certain rights in this invention.

CROSS-REFERENCE TO RELATED APPLICATION(S)

Reference is made to co-pending U.S. patent application Ser. No. 11/502,079, entitled TURBINE SHROUD THERMAL DISTORTION CONTROL, filed on the same date as this application.

BACKGROUND

The present invention relates to an outer shroud assembly for use in a gas turbine engine. More particularly, the present invention relates to a ceramic shroud assembly including a metal clamp ring shrink fitted around a ceramic shroud ring, where the metal clamp ring is configured to attach to a turbine engine casing.

As gas turbine engine operating temperatures have been elevated in order to increase engine efficiency, many metal alloy ("metal") gas turbine engine components, such as a shroud or rotor blade, have been targeted to be replaced by ceramic equivalents. Ceramic materials are able to withstand higher operating temperatures and require less cooling than metals. Ceramic components are also generally less sensitive to thermal expansion than metal components because ceramic materials generally exhibit a lower coefficient of thermal expansion (CTE) than a metal.

In one type of gas turbine engine, a static shroud ring is disposed radially outwardly from a turbine rotor, which includes a plurality of blades radially extending from a disc. The shroud ring at least partially defines a flow path for combustion gases as the gases pass from a combustor through turbine stages. There is typically a gap between the shroud ring and rotor blade tips in order to accommodate thermal expansion of both components during operation of the engine. The gap decreases during engine operation as the rotor blades thermally expand in a radial direction in reaction to high operating temperatures. It has been found that ceramic rotor blade tips experience a reduced radial displacement as compared to metal rotor blades because ceramic materials posses a lower CTE than metals. As a result, in a gas turbine engine incorporating ceramic rotor blades, there is a relatively large gap (or clearance) between the blade tips and the shroud ring. It is generally desirable to minimize the gap between a blade tip and shroud ring in order to minimize the percentage of hot combustion gases that leak through the tip region of the blade. The leakage reduces the amount of energy that is transferred from the gas flow to the turbine blades, which penalizes engine performance.

In order to minimize losses induced by relatively large clearances between rotor blade tips and static shroud rings, some gas turbine engines are able to reduce the clearance by utilizing a ceramic shroud ring rather than a metal shroud ring. A ceramic shroud ring undergoes less thermal distortion during engine operation than many metal shroud rings due to the higher stiffness, lower CTE, and higher thermal conductivity of ceramic materials as compared to metals. Furthermore, a ceramic shroud requires less cooling than a metal shroud because ceramic material is capable of withstanding higher operating temperatures.

In contrast to many metal shroud rings, it is difficult to attach a ceramic shroud ring to a metal gas turbine engine casing because the ceramic material exhibits a low ductility and a lower CTE than the metal casing. In general, stresses may generate at an interface between a ceramic component and a metal component because the ceramic and metal components react differently to the same temperature.

BRIEF SUMMARY

The present invention is a ceramic shroud assembly that allows a ceramic shroud to be attached to a metal gas turbine engine casing in a manner that compensates for a difference in CTEs between the ceramic and metal materials. The ceramic shroud assembly includes a metal clamp ring shrink fitted around a ceramic shroud and a compliant and insulating layer positioned between the ceramic shroud and the clamp ring. The metal clamp ring is configured to attach to the gas turbine engine casing, thereby attaching the ceramic shroud to the casing. The ceramic shroud assembly also includes a ring configured to axially restrain the ceramic shroud.

DETAILED DESCRIPTION

Figure 1:
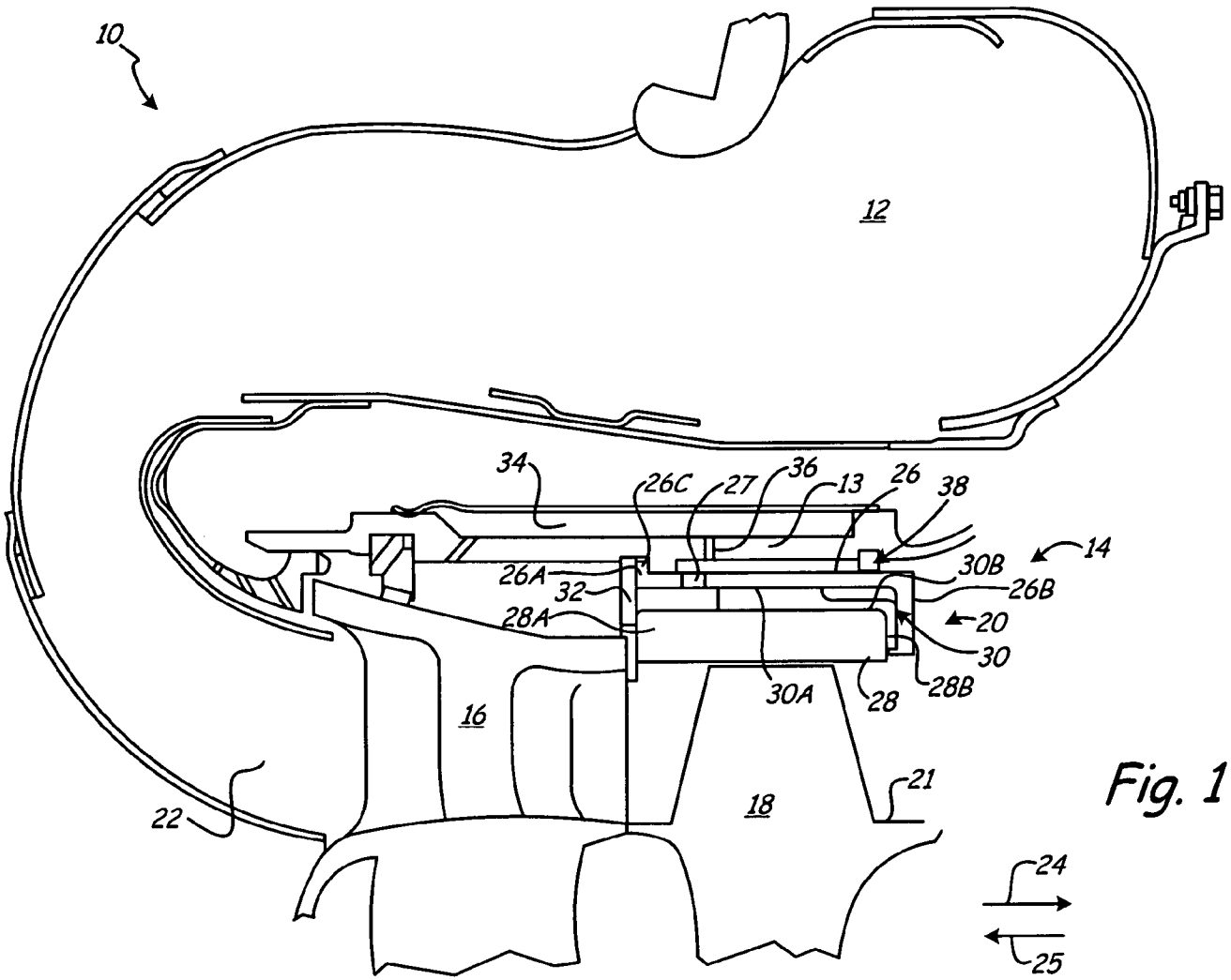
FIG. 1 is a partial cross-sectional view of a gas turbine engine including a combustion chamber and a first compressor turbine stage incorporating a ceramic shroud assembly in accordance with the present invention, which includes an insulating and compliant layer of material disposed between a metal clamp ring and a ceramic shroud, and an axial restraint ring for axially restraining the ceramic shroud.

FIG. 1 is a partial cross-sectional view of gas turbine engine 10, which includes combustion chamber 12, turbine engine casing 13, and first compressor turbine stage 14. First compressor turbine stage 14 includes a plurality of nozzle vanes 16 circumferentially arranged about casing 13, rotor blades 18 radially extending from a rotor disc (not shown), and ceramic shroud assembly 20 in accordance with the present invention. Shroud assembly 20 is attached to turbine engine casing 13.

During operation of gas turbine engine 10, hot gases from combustion chamber 12 enter first high pressure turbine stage 14 through turbine inlet region 22. More specifically, the hot gases move downstream (indicated by arrow 24) in an aft direction past a plurality of nozzle vanes 16. Nozzle vanes 16 direct the flow of hot gases past rotor blades 18, which radially extend from a rotor disc (not shown), as known in the art. Rotor blades 18 may be attached to the rotor disk using a mechanical attachment, such as a dovetail attachment, or may be integral with the rotor (i.e., an integrally bladed rotor). As known in the art, shroud assembly 20 defines an outer surface for guiding the flow of hot gases through first compressor turbine stage 14, while platform 21 positioned on an opposite end of rotor blade 18 from shroud assembly 20 defines an inner flow path surface.

Ceramic shroud assembly 20 in accordance with the present invention includes clamp ring 26, ceramic shroud 28, interlayer 30, which is positioned between clamp ring 26 and ceramic shroud 28, and axial restraint ring 32. Shroud assembly 20 allows for relative movement between ceramic and metal parts (i.e., between metal casing 13 and ceramic shroud 28), which helps compensate for a difference in thermal growth between metal casing 13 and ceramic shroud 28. As discussed in the Background section, when metal casing 13 and ceramic shroud 28 are directly interfaced, stresses may generate at the interface because of the difference in CTE values between the ceramic and metal materials. The stresses may cause shroud 28 to fail. Furthermore, it is relatively difficult to attach ceramic shroud 28 to metal gas turbine engine casing 13 because the ceramic material exhibits a low ductility.

Shroud assembly 20 of the present invention allows ceramic shroud 28 to be attached to metal casing 13 using metal clamp ring 26, which is configured to attach to metal turbine casing 13, such as by a mechanical attachment means (e.g., bolts). As discussed in further detail below, metal clamp ring 26 is shrink fit around ceramic shroud 28 and interlayer 30, which allows metal clamp ring 26 and shroud 28 to be attached, yet allows for relative thermal growth therebetween without generating undue stress on shroud 28. Shrink fitting is a process in which heat is used to produce a very strong joint between two components, one of which is at least partially inserted into the other. In the present invention, clamp ring 26 is heated to a "preheat temperature," which causes clamp ring 26 to expand. Upon expansion, ceramic shroud 28 and interlayer 30 are inserted into clamp ring 26. After clamp ring 26 cools, clamp ring 26 contracts, thereby compressing (or "clamping") ceramic shroud 28 and interlayer 30. In this way, clamp ring 26 holds shroud assembly 20 together by interference fit.

Clamp ring 26 is formed of a metal, such as a nickel-base alloy. Front face 26A of clamp ring 26 abuts axial restraint ring 32, while aft face 26B abuts an aft surface of ceramic shroud assembly 20. Flange 26C of clamp ring 26 is configured to mate with casing 13. In alternate embodiments, flange 26C may extend from clamp ring 26 in a different direction or may be removed from clamp ring 26, depending on a structure of casing 13. In one embodiment, clamp ring 26 and turbine casing 13 exhibit similar CTE values. In another embodiment, clamp ring 26 and turbine casing 13 exhibit different CTE values and clamp ring 26 is attached to turbine casing 13 using an attachment means allowing for relative growth therebetween (e.g., a U-slot). However, in either embodiment, metal clamp ring 26 and metal casing 13 interface, rather than metal casing 13 interfacing directly with ceramic shroud 28, which helps prevent the formation of stresses at an interface between ceramic shroud 28 and metal casing 13.

Clamp ring 26 includes a plurality of cooling holes 27, which are circumferentially positioned near front face 26A. Similarly, casing 13 includes a plurality of cooling holes 36. In order to cool shroud 28, which is exposed to hot combustion gases, cooling air is bled from a compressor region of turbine engine 10 to plenum 34 and through cooling holes 36 in casing 13 and cooling holes 27 in clamp ring 26. Air seal 38 may optionally be placed near aft face 26B of clamp ring 26 in order to help direct cooling air from cooling holes 36 through cooling holes 27, and minimize cooling air leakage.

Ceramic shroud 28 is a continuous uninterrupted annular ring having a substantially constant thickness (measured in a radial direction). Of course, in alternate embodiments, shroud 28 may also be formed of a plurality of split shroud segments in an annular arrangement. However, a continuous ring improves sealing about the outer flow path through first compressor stage 14, which helps increase the efficiency of turbine engine 10 by minimizing leakages of hot gases. Ceramic shroud 28 may be formed of any suitable material known in the art, such as silicon nitride.

Interlayer 30 is formed of a thermally insulating and compliant material exhibiting a relatively high compressive yield stress (e.g., greater than about $6\times10^6$ kilopascals (kPa)). In one embodiment, interlayer 30 is formed of mica, which exhibits a through thickness CTE of about $15\times10^{-6}/°$ C. to about $20\times10^{-6}/°$ C.

During operation of gas turbine engine 10, high operating temperatures cause clamp ring 26 and shroud 28 to expand (i.e., thermal growth). Clamp ring 26 is formed of a metal, while shroud 28 is formed of a ceramic material, and due to the difference in CTE values between metals and ceramics, clamp ring 26 is likely to encounter more thermal growth than shroud 28 during operation of gas turbine engine 10. In order to help absorb the thermal growth mismatch and help prevent stresses from forming between clamp ring 26 and shroud 28 due to the difference in CTE values, interlayer 30 is positioned between clamp ring 26 and shroud 28. Interlayer 30 is formed of a compliant and thermally insulative material. The compliancy of interlayer 30 helps absorb the thermal growth mismatch between clamp ring 26 and 28. Because interlayer 30 is also thermally insulative, interlayer 30 also helps isolate clamp ring 26 from combustion gases and heat flow from shroud 28 (which is at a high temperature due to the flow of hot gases between platform 21 and shroud 28) to clamp ring 26. Finally, interlayer 30 also helps prevent any chemical reaction between clamp ring 26 and shroud 28, which are formed of different materials.

Interlayer 30 includes first portion 30A and second portion 30B. A thickness of first portion 30A is greater than a thickness of second portion 30B. In the embodiment illustrated in FIG. 1, first portion 30A of interlayer 30 is about 2.54 millimeters (100 mils) thick, while second portion 30B is about 1.27 millimeters (50 mils) thick. In the embodiment shown in FIG. 1, only first portion 30A of interlayer 30 contacts both clamp ring 26 and shroud 28. First portion 30A is preferably substantially centered in the middle (i.e., midway between front axial face 28A and aft axial face 28B) of shroud 28 so that shroud 28 does not cone under the compressive stress of clamp ring 26. Second portion 30B covers approximately one-third of an aft portion (i.e., the portion closest to aft axial face 28B) of shroud 28, as well as aft axial face 28B. Second portion 30B of interlayer 30 thermally insulates the aft portion of shroud 28, as well as aft axial face 28, which helps to even out a temperature distribution across shroud 28, as described in co-pending U.S. patent application Ser. No. 11/502,079, entitled "TURBINE SHROUD THERMAL DISTORTION CONTROL," which was filed on the same date as the present application. In alternate embodiments, the percentage of shroud 28 covered by interlayer 30 may be adjusted, depending upon the desired temperature distribution across shroud 28.

Axial restraint ring 32 abuts front face 26A of clamp ring 26A and front face 28A of shroud 28, and helps restrain shroud 28 in an axial direction. Details of one embodiment of axial restraint ring 32 are described in reference to FIG. 4.

Figure 2:
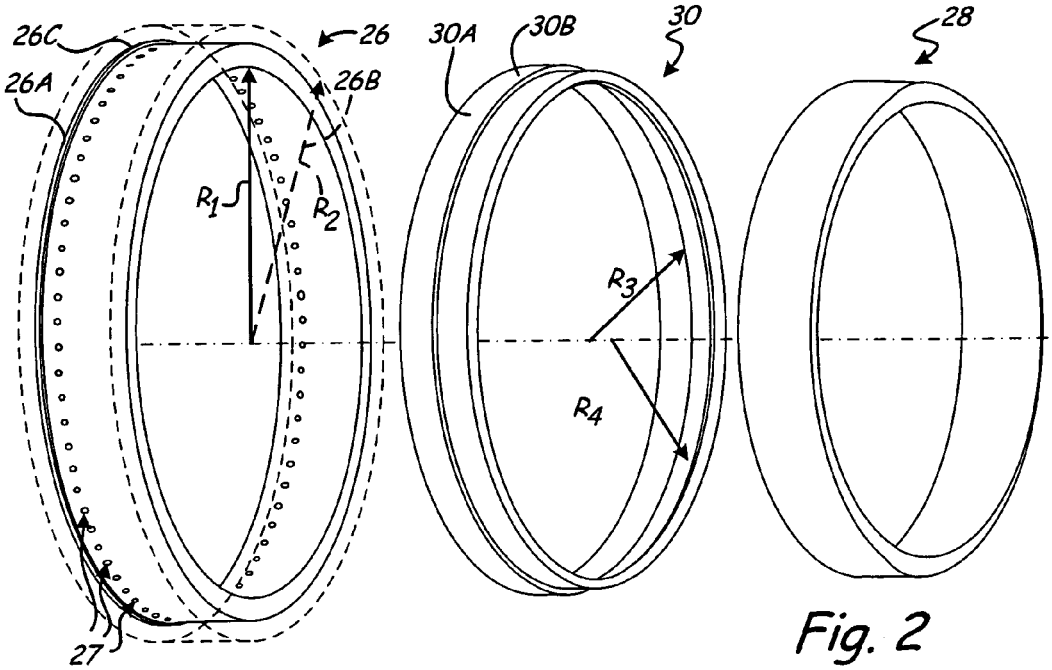
FIG. 2 is a perspective assembly view of a shroud assembly, which illustrates a process of shrink fitting a metal clamp ring around a ceramic shroud and an interlayer.

FIG. 2 is a perspective assembly view of shroud assembly 20, which illustrates a process of shrink fitting metal clamp ring 26 around shroud 28 and interlayer 30. Metal clamp ring 26 has radius $R_1$ and includes a plurality of cooling holes 27 near front face 26A. In order to shrink fit clamp ring 26 around shroud 28 and interlayer 30, clamp ring 26 is heated to a preheat temperature in order to expand lamp ring 26 to a size sufficient enough to receive shroud 28 and interlayer 30. Upon heating to a preheat temperature, metal clamp ring 26 expands to metal clamp ring 26 (shown in phantom) having radius $R_2$. The difference between $R_1$ and $R_2$ depends upon the material which metal clamp ring 26 is constructed of, as well as the preheat temperature. As those skilled in the art recognize, in general, the higher the preheat temperature, the greater the difference between $R_1$ and $R_2$.

After heating clamp ring 26, shroud 28 and interlayer 30, which are typically at room temperature (approximately 21-23° C.) (i.e., unexpanded), are introduced into expanded clamp ring 26. In one embodiment, interlayer 30 is attached to shroud 28 before being introduced into clamp ring 26. Because clamp ring 26 is expanded to radius $R_2$, shroud 28 and interlayer 30, which are approximately at room temperature, are able to fit within clamp ring 26. First portion 30A of interlayer 30 has outer radius $R_3$, while second portion 30B of interlayer 30 has outer radius $R_4$, which is less than radius $R_3$. In one embodiment, outer radius $R_3$ of first portion 30A is approximately equal to radius $R_2$ of heated and expanded clamp ring 26.

The preheat temperature of clamp ring 26 affects a clamp load which is applied to ceramic shroud 28 and interlayer 30. Generally, the higher the preheat temperature, the higher the clamp load and the higher the stress in clamp ring 26 for a given radius at the preheat temperature (after metal clamp ring 26 is brought back down to room temperature). This relationship is attributable to the fact that in a typical shrink fit process, the amount clamp ring 26 expands (i.e., the difference between $R_1$ and $R_2$) is generally proportional to the amount clamp ring 26 shrinks upon being returned to room temperature. The more clamp ring 26 shrinks, the greater the stresses generated in clamp ring 26 and the greater the load clamp ring 26 exerts on shroud 28. As a result of the relationship between clamp ring 26 expansion, stresses in clamp ring 26, and clamp loads, the preheat temperature is chosen based on the desirable stresses and clamp loads. The preheat temperature is preferably low enough to prevent metal clamp ring 26 from exceeding its yield limit or creep strength. On the other hand, the preheat temperature is preferably high enough to achieve a clamp load that is sufficient enough to hold shroud assembly 20 together during all engine 10 (FIG. 1) operation levels (e.g., from start-up to shutdown).

A finite element analysis was conducted with respect to one embodiment of gas turbine engine 10 (FIG. 1). The following preheat temperatures and associated stresses and clamp loads resulted:

TABLE 1

Stresses and Clamp Loads Resulting From Various Preheat Temperatures

| 1 Preheat Temperature (° C.) | 2 Maximum Von Mises Stress in Metal Clamp at Room Temperature (kPa) | 3 Maximum Von Mises Stress in Metal Clamp at Engine Steady State Conditions (kPa) | 4 First Principal Stress in Ceramic Shroud at Room Temperature (kPa) | 5 First Principal Stress in Ceramic Shroud at Engine Steady State Conditions (kPa) | 6 Clamp Load at Room Temperature (kiloNewton (kN)) | 7 Clamp Load at Engine Steady State Conditions (kN) |
|---|---|---|---|---|---|---|
| 204 (400° F.) | $3.86 \times 10^5$ (56 ksi) | $1.65 \times 10^5$ (24 ksi) | $2.76 \times 10^4$ (4 ksi) | $6.21 \times 10^4$ (9 ksi) | 42.26 (9500 lbf) | 7.18 (1600 lbf) |
| 260 (500° F.) | $4.96 \times 10^5$ (72 ksi) | $2.76 \times 10^5$ (40 ksi) | $3.45 \times 10^4$ (5 ksi) | $6.21 \times 10^4$ (9 ksi) | 53.38 (12000 lbf) | 22.24 (5000 lbf) |
| 316 (600° F.) | $6.07 \times 10^5$ (88 ksi) | $4.14 \times 10^4$ (60 ksi) | $4.14 \times 10^4$ (6 ksi) | $6.21 \times 10^4$ (9 ksi) | 66.72 (15000 lbf) | 40.03 (9000 lbf) |

The finite element analysis was conducted with respect to three preheat temperatures, which are listed in Column 1 of Table 1. Column 2 lists the maximum Von Mises stress values for clamp ring 26 after clamp ring 26 is heated to the respective preheat temperature listed in Column 1 to reach a radius R3 from radius R2 and subsequently cooled to room temperature. Column 3 lists, for each of the preheat temperatures, the maximum Von Mises stress value for metal clamp ring 26 during gas turbine engine 10 (FIG. 1) steady state conditions, at which condition metal clamp ring 26 is exposed to operating temperatures of up to 426° C. (about 800 F.°. Column 4 lists, for each of the preheat temperatures, the first principal stress in shroud 28 at room temperature, after metal clamp ring 26 is shrink fit around shroud 28 and interlayer 30. Column 5 lists, for each of the preheat temperatures, the first principal stress in shroud 28 during gas turbine engine 10 steady-state conditions. Column 6 lists, for each of the preheat temperatures, the clamp load metal clamp ring 26 exerts on shroud 28 at room temperature. And finally, Column 7 lists, for each of the preheat temperatures, the clamp load metal clamp ring 26 exerts on shroud 28 during gas turbine engine 10 steady-state conditions.

As seen from the data listed in Table 1, as the preheat temperature increases, the Von Mises stress in clamp ring 26 and clamp load applied by clamp ring 26 increase at both room temperature and engine 10 steady-state conditions. Both the Von Mises stress and clamp load drop from room temperature conditions to steady-state conditions because clamp ring 26 expands in response to the increased operating temperatures, and clamp ring 26 expands more than shroud 28 due to the difference to CTE of ceramic shroud 28 and metal clamp ring 26. When clamp ring 26 expands more than shroud 28, the amount of interference fit between clamp ring 26 and shroud 28 is decreased. In one embodiment, clamp ring 26 is formed of Inconel 783, which is an oxidation-resistant nickel-based superalloy. Inconel 783 exhibits a yield stress of about $7.58\times10^6$ kPa (about 110 ksi per square inch (ksi)). At each of the preheat temperatures in Table 1, the maximum Von Mises stress for clamp ring 26 is below the yield stress of Inconel 783. Therefore, for clamp ring 26 formed of Inconel 783, preheat temperatures ranging from about 204° C. to about 316° C. are suitable.

Maintaining a suitable clamp load during engine transient conditions (i.e., when a transition is made from one engine power output level to another) is also in important factor in determining the preheat temperature. Due to different CTE and heat transfer characteristics of metal clamp ring 26 and ceramic shroud 28, a thermal response of metal clamp ring 26 and ceramic shroud 28 to the same power output level can differ, which may impact the clamp load. For example, during engine start-up, ceramic shroud 28 typically heats up faster than metal clamp ring 26 because of a more rapid change in heat transfer boundary conditions of shroud 28. That is, because shroud 28 is directly exposed to hot combustion gases, shroud 28 tends to heat up and expand faster than clamp ring 26. When shroud 28 expands faster than clamp ring 26, clamp load and stress in clamp ring 26 increases because shroud 28 pushes against clamp ring 26. Therefore it is important to know what is the minimum clamp load during engine transient.

Engine start-up and shut-down were simulated using finite element analysis in order to determine the load exerted by clamp ring 26 on shroud 28, and the Von Mises stress of clamp ring 26. Table 2 illustrates the results of the finite element analysis for stresses and clamp loads during engine 10 start-up conditions:

TABLE 2

Stresses and Clamp Loads during Engine Start-up Conditions

| Preheat Temperature (° C.) | Maximum Von Mises Stress in Metal Clamp (kPa) | First Principal Stress in Ceramic Shroud at Engine Steady State Conditions (kPa) | Minimum Clamp Load (kN) |
|---|---|---|---|
| 260 (500° F.) | $6.21\times10^5$ (90 ksi) | $4.83\times10^4$ (7 ksi) | 22.24 (5000 lbf) |
| 316 (600° F.) | $6.89\times10^5$ (100 ksi) | $6.21\times10^4$ (9 ksi) | 40.03 (9000 lbf) |

Table 3 illustrates the results of the finite element analysis for stresses and clamp loads during engine 10 shutdown conditions:

TABLE 3

Stresses and Clamp Loads During Engine Shutdown Conditions

| Preheat Temperature (° C.) | Maximum Von Mises Stress in Metal Clamp (kPa) | First Principal Stress in Ceramic Shroud at Engine Steady State Conditions (kPa) | Minimum Clamp Load (kN) |
|---|---|---|---|
| 260 (500° F.) | $4.14\times10^5$ (60 ksi) | $3.45\times10^4$ (5 ksi) | 7.18 (1600 lbf) |
| 316 (600° F.) | $6.21\times10^5$ (90 ksi) | $1.45\times10^5$ (21 ksi) | 9.34 (2100 lbf) |

In the embodiment in which clamp ring 26 is formed of Inconel 783, the stresses in clamp ring 26 remain below the yield stress of Inconel 783 (about $7.58\times10^5$ kPa) during engine 10 start-up and shutdown conditions when the preheat temperature of clamp ring 26 is up to about 316° C. Thus, for an Inconel 783 clamp ring 26 (or a material exhibiting similar properties), a preheat temperature of about 316° C. is suitable.

During engine 10 shutdown, shroud 28 contracts faster than clamp ring 26 and it is critical to maintain a minimum clamp load. As shown in Table 3, at engine 10 shutdown, minimum clamp loads drop compared to clamp loads at steady-state engine 10 operating conditions (detailed in Table 1). A concern at engine 10 shutdown is whether clamp ring 26 will apply sufficient clamp load on shroud 28. As previously discussed, the preheat temperature is dependent upon the desirable clamp loads. For example, if a clamp load of approximately 7.18 kN needs to be maintained at all times to maintain the integrity of shroud assembly 20, the lower limit of a preheat temperature is about 260° C.

It is also desirable for ceramic shroud 28 to remain under compression for substantially all engine conditions because ceramic material is stronger in a compressive stress state than in a tensile stress state. For an Inconel 783 clamp ring 26, it has been found that if the preheat temperature is selected in the range of about 260° C. to about 316° C., ceramic shroud 28 remains under compression for all engine conditions, while at the same time, clamp ring 26 operates below its yield limit.

Figure 3:
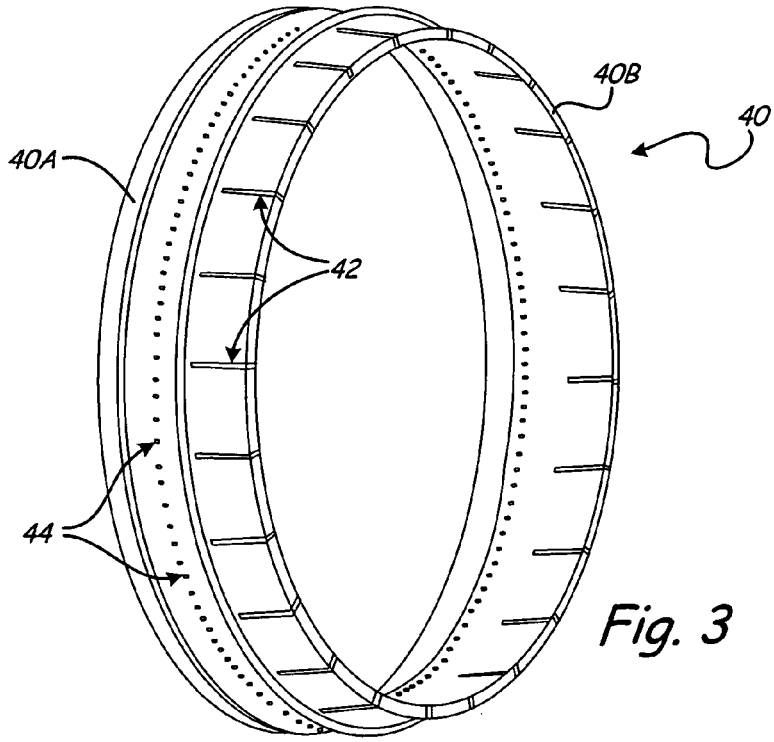
FIG. 3 is a perspective view of an alternate embodiment of a clamp ring of a ceramic shroud assembly of the present invention, where the clamp ring includes a plurality of axially extending slots.

FIG. 3 is a perspective view of an alternate embodiment of clamp ring 40, which includes a plurality of axially-extending slots 42 extending from front face 40A to aft face 40B, and a plurality of cooling holes 44. Slots 42 increase the radial compliance of clamp ring 40 and allow a shroud (e.g., shroud 28 of FIG. 1) disposed inside clamp ring 40 to expand without generating undue stress on the shroud or clamp ring 40.

Figure 4:
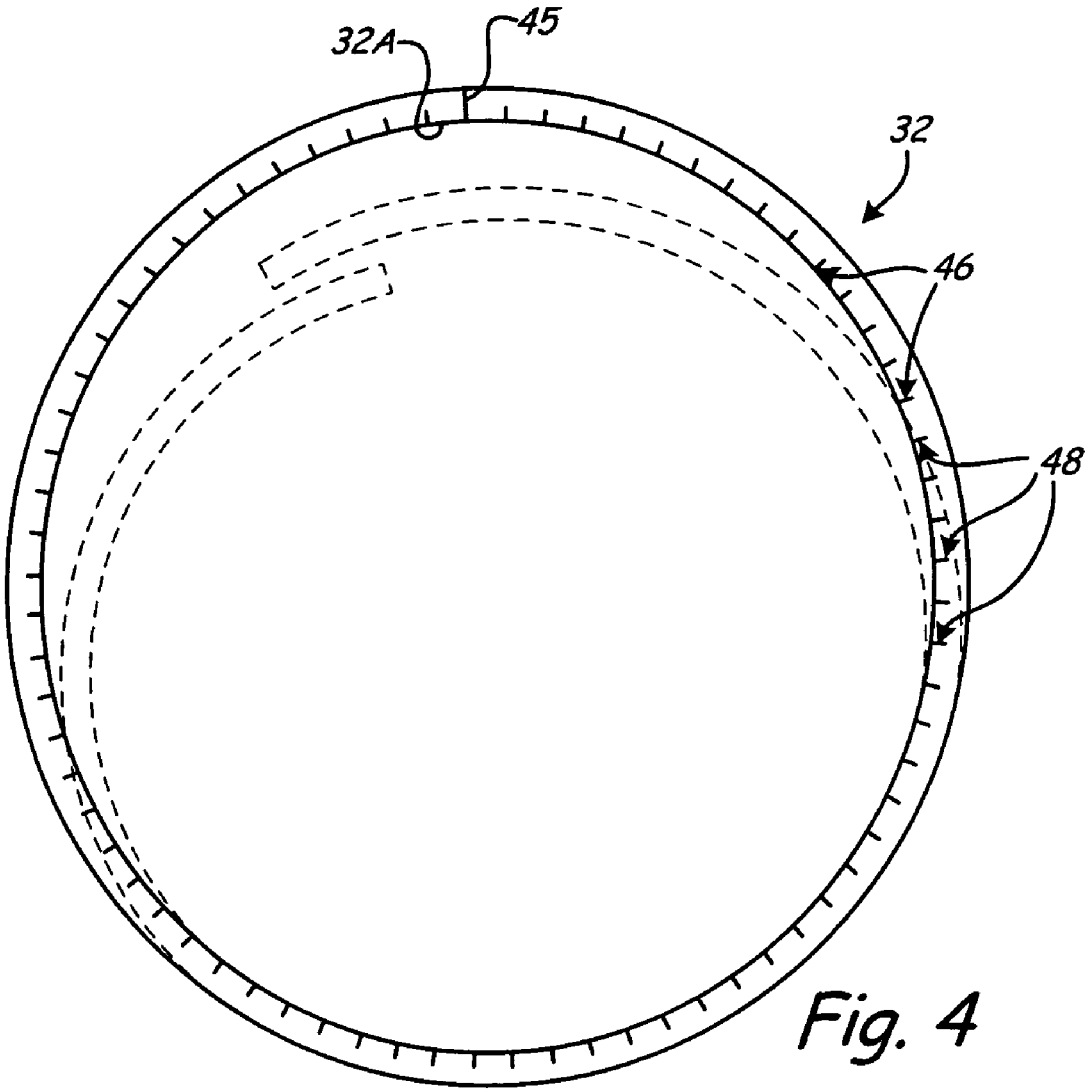
FIG. 4 is a plan view of axial restraint ring, which includes a plurality of radially extending cuts along its inner radius.

FIG. 4 is a plan view of axial restraint ring 32, which includes slot 45 and a plurality of radially extending cuts 46 along inner radius 32A. In the embodiment illustrated in FIG. 1, axial restraint ring 32 is a snap ring, which, as known in the art, is a discontinuous annular ring that can be distorted to decrease its diameter. In order to fit axial restraint ring 32 into assembly 20 (shown in FIG. 1) and retain axial restraint 32 in place, a force is applied to axial restraint ring 32 in order to decrease its diameter, as shown in phantom. Axial restraint ring 32 is then fit into turbine casing 13 (shown in FIG. 1), after which, the force applied to axial restraint ring 32 is released, thereby increasing the diameter of axial restraint ring 32, allowing axial restraint ring 32 to "snap" into place. Because axial restraint ring 32 is a greater diameter than casing 13, axial restraint ring 32 exerts a radial force on casing 13, which helps axial restraint ring 32 retain its position. Axial restraint ring 32 is formed of any suitable material, such as a nickel-based alloy (e.g., Inconel 625).

Radial cuts 46 in axial restraint ring 32 define a plurality of radial tabs 48 that are configured to push against front face 28A of shroud 28 (shown in FIG. 1) in order to axially restraint shroud 28 and prevent movement of shroud 28 in an upstream direction 25 (shown in FIG. 1). In one embodiment, tabs 48 are coated with a coating that reduces heat transfer from shroud 28 to tabs 48 and prevents reaction between axial restraint ring 32 and shroud 28. The coating may be, for example, a ceramic thermal barrier coating known in the art, such as yttria stabilized zirconia. Radial cuts 46 also allow for cooling air from chamber 34 (which has flowed through cooling holes 36 in casing 13 and cooling holes 27 in metal clamp ring 26) to cool axial restraint ring 32.

Figure 5:
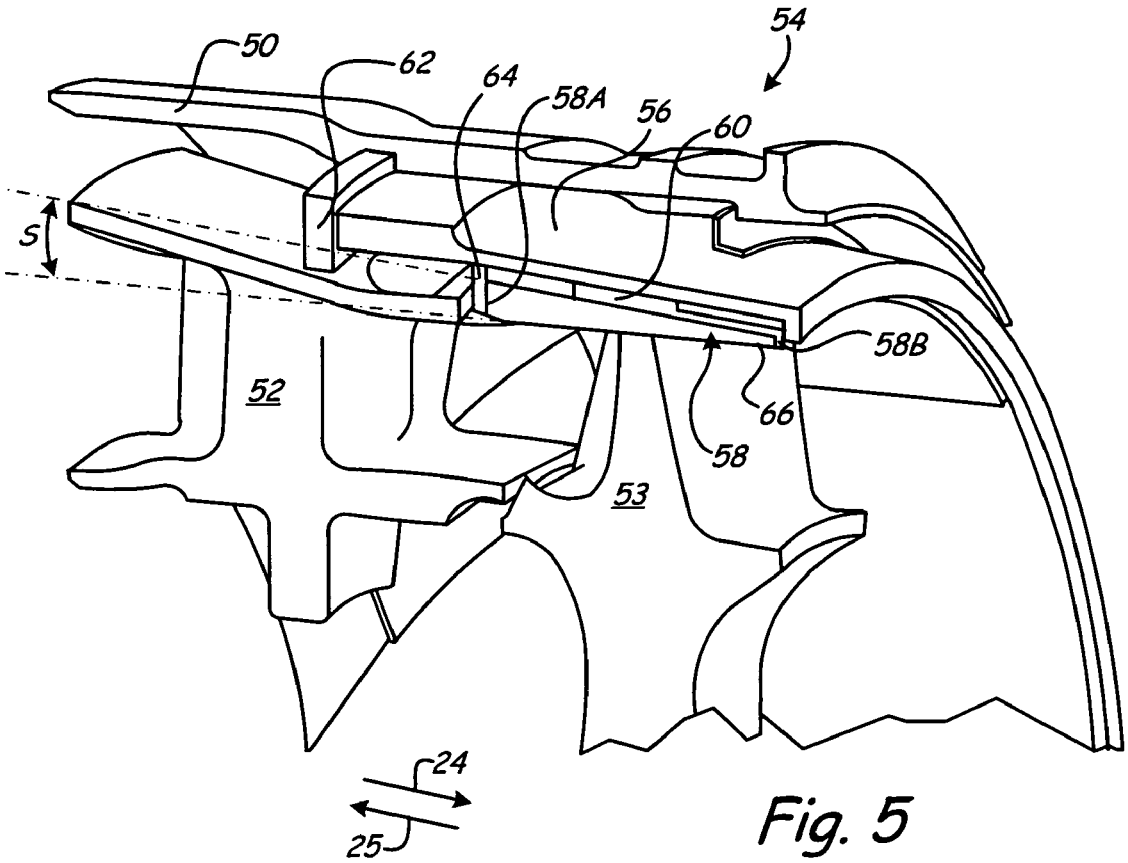
FIG. 5 is a partial perspective cross-sectional view of a turbine vane, first stage turbine rotor, and a second embodiment of a ceramic shroud assembly, which includes a shroud that is tapered at an angle S with respect an axial centerline of a turbine engine.

FIG. 5 is a partial perspective cross-sectional view of turbine engine casing 50, turbine vane 52, turbine rotor 53, and a second embodiment of ceramic shroud assembly 54, which is similar to ceramic shroud assembly 20 of FIG. 1, except that shroud 58 is tapered at angle S with respect to line 66, which is parallel to an axial centerline of turbine engine 10, from front face 58A to aft face 58B. In the embodiment illustrated in FIG. 5, angle S is about 10 degrees. Shroud assembly 54 further includes clamp ring 56, which is attached to turbine casing 50, interlayer 60, first axial restraint ring 62, and second axial restraint ring 64. Clamp ring 56 is also tapered to match shroud 58, such that clamp ring 56 and shroud 58 have similar contours. Interlayer 60 is similar to interlayer 30 of FIG. 1. First axial restraint ring 62 helps locate clamp ring 56 such that clamp ring 56 does not move in an upstream direction (indicated by arrow 25).

Taper angle S of shroud 58 is governed by a frictional coefficient that is necessary to keep shroud 58 located axially (i.e., prevent shroud 58 from moving in aft (or downstream) direction 24 or upstream direction 25). For a high coefficient of friction (e.g., 0.6), taper angle S may be up to 31° with respect to line 66 without compromising the axial location of shroud 58. Although there is a radial component to the force with which clamp ring 56 compresses shroud 58, the embodiment of shroud assembly 54 in FIG. 5 also provides an axial force that pushes shroud 58 in the aft direction (indicated by arrow 24), against aft surface 56B of clamp ring 56, thereby helping to prevent shroud 58 from moving in the aft direction 24. As an additional measure for maintaining the axial location of shroud 58, front face 58A of shroud 58 is axially restrained by second axial restraint ring 64.

Figure 6:
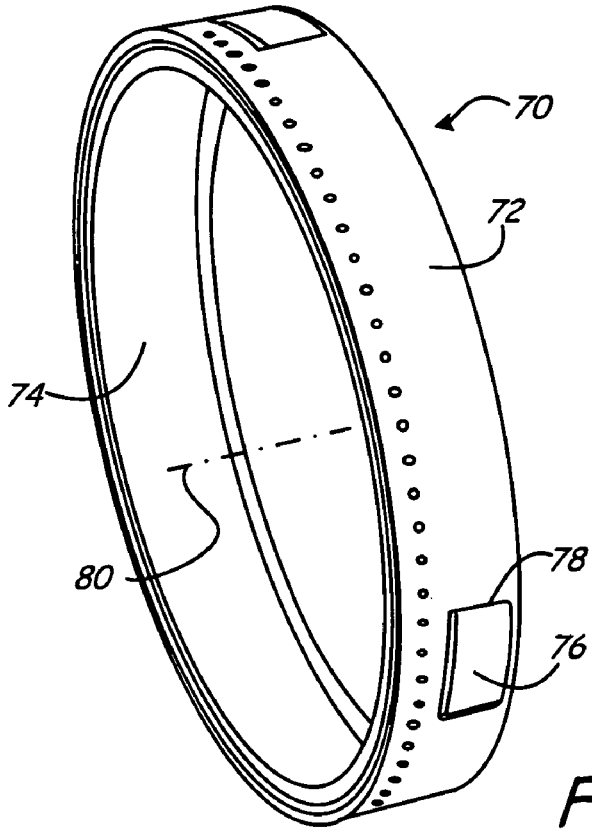
FIG. 6 is a perspective view of a third embodiment of a shroud assembly, which includes a shroud with anti-rotation tabs that are configured to engage with openings in a clamp ring.

FIG. 6 is a perspective view of a third embodiment of shroud assembly 70 including clamp ring 72 and shroud 74. Shroud assembly 70 also includes an interlayer (not shown) positioned between clamp ring 72 and shroud 74. Shroud assembly 70 is similar to shroud assembly 20 of FIG. 1, except that shroud 74 includes a plurality of anti-rotation tabs 76, which are configured to engage with corresponding openings 78 in clamp ring 72. Anti-rotation tabs 76 circumferentially locate shroud 74 with respect to clamp ring 72, and help limit rotational movement of shroud 74 about center axis 80. In addition, friction between clamp ring 72 and shroud 74 generated by the shrink-fit process helps circumferentially locate shroud 74. In the embodiment shown in FIG. 5, shroud 74 includes three equally spaced anti-rotation tabs 76. However, in alternate embodiments, shroud 74 may include any suitable number of anti-rotation tabs 76, such as two, four, five, etc., as well as any suitable arrangement (e.g., equally or unequally spaced). In the alternate embodiments, clamp ring 72 includes a corresponding number of openings 78.

Figure 7:
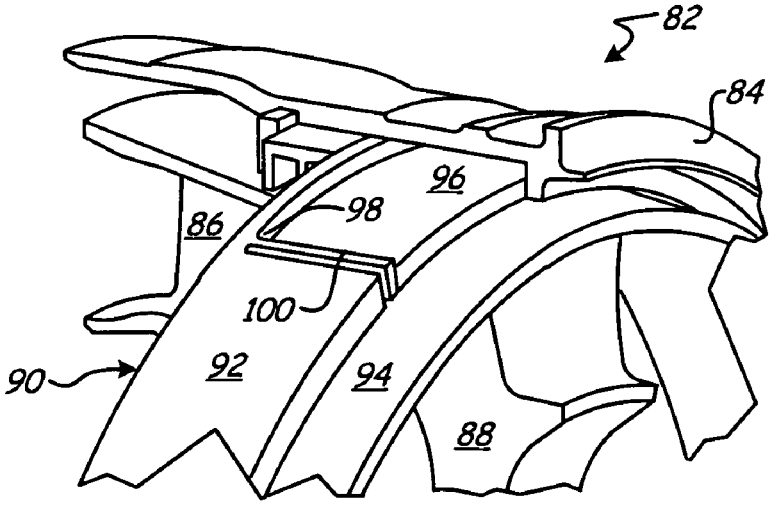
FIG. 7 is a partial perspective cross-sectional view of a fourth embodiment of a shroud assembly, which includes a shroud with an anti-rotation tab that is configured to engage with an opening in a clamp ring, the opening including a leaf spring that positions the tab within the opening.

FIG. 7 is a partial perspective cross-sectional view of gas turbine engine 82, which includes turbine casing 84 (similar to turbine casing 13 of FIG. 1), stationary vane 86 (similar to stationary vane 16 of FIG. 1), turbine rotor 88 (similar to rotor blade 18 of FIG. 1), and a fourth embodiment of shroud assembly 90. Shroud assembly 90 includes clamp ring 92, shroud 94, and an interlayer (not shown in FIG. 7) positioned between clamp ring 92 and shroud 94. Similar to shroud 74 of FIG. 6, shroud 94 includes anti-rotation tab 96, which is configured to engage with a corresponding opening 98 in clamp ring 92. However, unlike the third embodiment of shroud assembly 70, in the fourth embodiment of shroud assembly 90, openings 98 in clamp ring 92 each include leaf spring 100. Leaf spring 100 allows opening 98 to be adaptable to different anti-rotation tab 96 locations by providing a range of locations for which anti-rotation tab 96 may be introduced into opening 98, while still allowing opening 98 to engage with anti-rotation tab 96. Leaf spring 100 preferably has a controlled stiffness that keeps shroud 94 in position without introducing high stress in shroud 94. In another embodiment, a second leaf spring is located on opening 98 opposite leaf spring 100. Shroud assembly 90 may be modified to include any suitable number of leaf springs.

While a shroud assembly in accordance with the present invention has been described in reference to a first high pressure turbine stage, the inventive shroud assembly is suitable for incorporation into any turbine stage of a gas turbine engine, as well as any other application of a shroud ring.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A ceramic shroud assembly comprising:

a ceramic shroud comprising:

an inner surface;

an outer surface opposite the inner surface;

a front face extending between the inner surface and the outer surface; and an aft face opposite the front face;

a first metal ring having a front face and an aft face configured to attach to a turbine engine casing;

a compliant and thermally-insulating layer positioned between the ceramic shroud and the first metal ring, the compliant and thermally-insulating layer comprising:

a first portion configured to contact both the ceramic shroud and the first metal ring and having a first constant thickness; and a second portion configured to contact only the ceramic shroud and having a second constant thickness that is less than the first constant thickness; and a second metal ring configured as a discontinuous snap ring capable of distortions in shape and positioned directly adjacent to the ceramic shroud in order to axially restrain the ceramic shroud.

2. The ceramic shroud assembly of claim 1, wherein the second metal ring abuts the front face of the ceramic shroud.

3. The ceramic shroud assembly of claim 2, wherein the second metal ring comprises:

an inner surface adjacent to the ceramic shroud;

an outer surface; and a plurality of radial slots extending from the inner surface toward the outer surface and defining a plurality of radial tabs, the plurality of radial tabs being configured to bias against the front face of the ceramic shroud.

4. The ceramic shroud assembly of claim 1, wherein the first metal ring is formed of a material comprising a nickel-based alloy.

5. The ceramic shroud assembly of claim 1, wherein the first metal ring includes a plurality of axial slots having an open end at the aft face of the first metal ring to allow the ceramic shroud to expand.

6. The ceramic shroud assembly of claim 1, wherein the compliant and thermally-insulating layer covers at least a part of the aft face of the ceramic shroud.

7. The ceramic shroud assembly of claim 1, wherein the first thickness is about 0.254 centimeters and the second thickness is about 0.127 centimeters.

8. The ceramic shroud assembly of claim 1, wherein the outer surface of the ceramic shroud comprises an anti-rotation tab, and the first metal ring comprises an opening configured to receive the anti-rotation tab of the ceramic shroud.

9. The ceramic shroud assembly of claim 8, wherein the anti-rotation tab has a perimeter defined by four angles each approximately 90°, and wherein a radial dimension of the anti-rotation tab is small relative to axial and circumferential dimensions of the anti-rotation tab.

10. The ceramic shroud assembly of claim 1, wherein the ceramic shroud is tapered from the front face to the aft face.

11. The ceramic shroud assembly of claim 10, wherein the ceramic shroud is tapered at an angle in a range of about 10 degrees to about 31 degrees with respect to a centerline of the gas turbine engine.

12. The method of claim 1, wherein the first metal ring is made from a material that has a yield stress above $6.89\times10^5$ kPa.

13. The method of claim 12, wherein the material is an oxidation-resistant nickel-based superalloy.

14. A ceramic shroud assembly comprising:

a ceramic shroud comprising:

an inner surface; and an outer surface opposite the inner surface;

a clamp ring shrink fitted around at least a part of the outer surface of the ceramic shroud and configured to attach to a turbine engine casing, wherein the clamp ring is made from a material that has a yield stress above $6.89\times10^5$ kPa and the clamp ring is preheated to a preheat temperature in a range of about 204 to about 316 degrees Celsius;

an axial restraint ring configured as a snap ring and positioned adjacent to the ceramic shroud to axially restrain the ceramic shroud; and a compliant and thermally-insulating layer positioned between the ceramic shroud and the clamp ring.

15. The method of claim 14, wherein the first metal ring is an oxidation-resistant nickel-based superalloy.

16. The ceramic shroud assembly of claim 14, wherein the outer surface of the ceramic shroud includes an anti-rotation tab, and the clamp ring includes an opening configured to receive the anti-rotation tab of the ceramic shroud.

17. The ceramic shroud assembly of claim 16, wherein the anti-rotation tab has a perimeter defined by four angles each approximately 90°, and wherein a radial dimension of the anti-rotation tab is small relative to axial and circumferential dimensions of the anti-rotation tab.

18. A method of assembling a ceramic shroud assembly suitable for use in a gas turbine engine, the method comprising:

preheating a first ring comprising an inner diameter to a preheat temperature, wherein after cooling down from the preheat temperature, a stress in the first ring is below a yield limit of the first ring;

attaching an insulating and compliant layer comprising an outer diameter to a ceramic shroud;

introducing the ceramic shroud and the insulating and compliant layer into the first ring, wherein the insulating layer and complaint layer is positioned between the first ring and the ceramic shroud; and positioning an axial restraint ring adjacent to the ceramic shroud.

19. The method of claim 18, wherein the preheat temperature is in a range of about 204 to about 316 degrees Celsius.

20. A ceramic shroud assembly comprising:

a ceramic shroud comprising:

an inner surface;

an outer surface opposite the inner surface, the outer surface comprising an anti-rotation tab;

a first axial face extending between the inner surface and the outer surface; and a second axial face opposite the first axial face;

a first metal ring shrink fitted around at least a part of the outer surface of the ceramic shroud and configured to attach to a turbine engine casing;

a compliant and thermally-insulating layer positioned between the ceramic shroud and the first metal ring; and a second metal ring configured to axially restrain the ceramic shroud, wherein the outer surface of the ceramic shroud comprises an anti-rotation tab, the first metal ring comprises an opening configured to receive the anti-rotation tab of the ceramic shroud, and a leaf spring is positioned between the anti-rotation tab and the opening in the first metal ring.

* * * * *